US009717650B2

(12) United States Patent
Johnston et al.

(10) Patent No.: US 9,717,650 B2
(45) Date of Patent: Aug. 1, 2017

(54) CHILD RESISTANT PACKAGING

(71) Applicant: Multi Packaging Solutions UK Limited, Nottingham (GB)

(72) Inventors: Spencer Johnston, Lincoln (GB); David Bills, Lincolnshire (GB)

(73) Assignee: Multi Packaging Solutions UK Limited, Nottingham (GB)

( * ) Notice: Subject to any disclaimer, the term of this patent is extended or adjusted under 35 U.S.C. 154(b) by 0 days.

(21) Appl. No.: 14/634,136

(22) Filed: Feb. 27, 2015

(65) Prior Publication Data

US 2015/0245980 A1 Sep. 3, 2015

(30) Foreign Application Priority Data

Feb. 28, 2014 (GB) ..... 1403583.6

(51) Int. Cl.
*A61J 1/03* (2006.01)
*B65D 25/20* (2006.01)
(Continued)

(52) U.S. Cl.
CPC ..... *A61J 1/035* (2013.01); *B65D 17/163* (2013.01); *B65D 17/24* (2013.01); *B65D 25/205* (2013.01); *B65D 65/14* (2013.01); *B65D 65/38* (2013.01); *B65D 75/327* (2013.01); *B65D 75/367* (2013.01); *B65D 75/527* (2013.01); *G09F 3/00* (2013.01); *B65D 2215/04* (2013.01); *B65D 2575/3227* (2013.01); *B65D 2575/3236* (2013.01); *G09F 2003/0222* (2013.01); *G09F 2003/0272* (2013.01)

(58) Field of Classification Search
CPC .... B65D 65/38; B65D 75/36; B65D 2215/04; B65D 75/367; A61J 1/035
USPC ..... 206/528, 530, 531, 534.1, 534.2, 539, 206/461, 467, 469; 383/203
See application file for complete search history.

(56) References Cited

U.S. PATENT DOCUMENTS 3,948,394 A 4/1976 Hellstrom
5,325,968 A 7/1994 Sowden
(Continued)

FOREIGN PATENT DOCUMENTS

EP 2589365 5/2013
GB 2414982 8/2007
(Continued)

OTHER PUBLICATIONS

UK Search Report dated Mar. 28, 2014.
EP search report for EP15157010.8 dated Jul. 23, 2015.

*Primary Examiner* — Chun Cheung
(74) *Attorney, Agent, or Firm* — O'Shea Getz P.C.

(57) ABSTRACT

A child resistant blister pack includes a blister layer which includes one or more blister cavities for receiving a product. A frangible retaining layer is attached to the blister layer over the blister cavities to retain the product within the blister cavities. A first backing layer is attached to the retaining layer on a side opposite the blister layer. The first backing layer has one or more lines of weakness aligned with the blister cavities. A second backing layer is attached to the first backing layer on a side opposite the retaining layer. The second backing layer has a plurality of removable sections. At least two removable sections are arranged over each line of weakness in the underlying first backing layer.

17 Claims, 2 Drawing Sheets

(51) Int. Cl.

| | |
|---|---|
| ***G09F 3/00*** | (2006.01) |
| ***B65D 65/38*** | (2006.01) |
| ***B65D 75/52*** | (2006.01) |
| ***B65D 17/00*** | (2006.01) |
| ***B65D 65/14*** | (2006.01) |
| ***B65D 75/32*** | (2006.01) |
| ***B65D 75/36*** | (2006.01) |
| *G09F 3/02* | (2006.01) |

(56) References Cited

U.S. PATENT DOCUMENTS

| | | | | |
|---|---|---|---|---|
| 5,339,960 | A * | 8/1994 | Price | B65D 75/327 206/531 |
| 5,469,968 | A * | 11/1995 | Matthews | B65D 75/327 206/484 |
| 6,155,423 | A | 12/2000 | Katzner et al. | |
| 6,161,699 | A | 12/2000 | Gartland | |
| 6,357,593 | B1 | 3/2002 | Bolnick et al. | |
| 6,945,400 | B2 | 9/2005 | Bolnick et al. | |
| 6,951,282 | B2 * | 10/2005 | Jones | B65D 75/367 206/469 |
| 7,121,410 | B2 | 10/2006 | Rohrmus et al. | |
| 7,316,317 | B2 | 1/2008 | Harper | |
| 7,395,928 | B2 | 7/2008 | Bertsch et al. | |
| 2003/0111379 | A1 * | 6/2003 | Intini | B65D 75/367 206/531 |
| 2003/0213721 | A1 | 11/2003 | Jones | |
| 2004/0188312 | A1 | 9/2004 | Stepowany | |
| 2004/0222122 | A1 * | 11/2004 | Intini | B65D 75/367 206/532 |
| 2004/0245145 | A1 * | 12/2004 | Urban | B65D 75/36 206/531 |
| 2007/0119742 | A1 * | 5/2007 | Thielman | B65D 75/5838 206/494 |
| 2007/0227932 | A1 | 10/2007 | Bobbett et al. | |
| 2008/0155941 | A1 | 7/2008 | Williams-Hartman | |
| 2008/0308449 | A1 * | 12/2008 | Intini | B65D 75/327 206/532 |
| 2009/0188832 | A1 | 7/2009 | Pham | |
| 2010/0213097 | A1 | 8/2010 | Paliotta et al. | |
| 2011/0162330 | A1 | 7/2011 | Cotton et al. | |
| 2012/0193904 | A1 | 8/2012 | Ludwig et al. | |
| 2013/0081968 | A1 | 4/2013 | Kurtze et al. | |
| 2013/0256183 | A1 | 10/2013 | Ingraham | |

FOREIGN PATENT DOCUMENTS

| | | |
|---|---|---|
| WO | 0102265 | 1/2001 |
| WO | 2004108553 | 12/2004 |

* cited by examiner

CHILD RESISTANT PACKAGING

This application is entitled to the benefit of and incorporates by reference essential subject matter disclosed in United Kingdom Application No. 1403583.6 filed on Feb. 28, 2014.

BACKGROUND OF THE INVENTION

1. Technical Field

The present invention relates to child resistant packaging and particular to child resistant blister packs.

2. Background Information

It is common to package single dose items such as pharmaceutical products in blister packs. A blister pack typically comprises a blister layer having one or more blister cavities for receiving the product and a frangible retaining layer attached to the blister layer over the blister cavities to retain the product within the blister cavities. In order to remove the product from the pack, a user simply pushes the product from the blister cavity through the frangible retaining layer. Such a construction may not, however, provide adequate protection against children gaining access to the product. Accordingly, there is a need for a child resistant blister pack.

SUMMARY OF THE INVENTION

From a first aspect, therefore, the invention provides a child resistant blister pack, the blister pack comprising: a blister layer comprising one or more blister cavities for receiving a product; a frangible retaining layer attached to said blister layer over said one or more blister cavities to retain product within the one or more blister cavities; a first backing layer attached to said retaining layer on a side opposite said blister layer, said first backing layer comprising one or more lines of weakness aligned with a said blister cavity; and a second backing layer attached to said first backing layer on a side opposite said retaining layer; said second backing layer comprising a plurality of removable sections, wherein at least two removable sections are arranged over the said line or lines of weakness in the underlying first backing layer.

In accordance with the invention, therefore, two backing layers are provided over a retaining layer of the blister pack. A first backing layer comprises a line of weakness which is aligned with the blister cavity. In addition, a second backing layer is provided which has a plurality of sections, at least two of the sections being aligned over each line of weakness in the first backing layer. Respective lines of weakness and removable sections may be provided for each blister cavity. In order for a user to remove a product from the blister pack, it is necessary for a user first to remove at least two sections of the second backing layer in order to expose the underlying line or lines of weakness in the first backing layer. Only then can a user press the product from the blister cavity through the frangible retaining layer and through the line or lines of weakness in the first backing layer. This arrangement provides a high level of child resistance since the child will have to perform at least three operations to remove the product namely removing two sections of the second backing layer and then pushing the product through the first backing layer. At the same time, adults will still be able easily to remove the product.

The line or lines of weakness in the first backing layer may be formed in any convenient manner, but typically are formed as perforations or cuts in the layer.

Preferably, the line or lines of weakness extend substantially across a full dimension, preferably a lengthwise dimension, of the blister cavity so as to facilitate removal of the product from the blister cavity. However, this is not essential, and in appropriate circumstances, the line or lines of weakness may not extend completely across the blister cavity.

Preferably just a single line of weakness is provided per blister cavity.

Generally the line or lines of weakness will be aligned with a major axis of the blister cavity.

The major axis of the blister cavity may be aligned at an angle to the longitudinal axis of the blister pack.

The first backing layer is preferably attached to the retaining layer by means of a permanent adhesive. Moreover, the second backing layer is preferably attached to the first backing layer by means of a peelable adhesive. This ensures that the removable sections may easily be peeled away from the first backing layer without danger of the first backing layer delaminating from the retaining layer, thereby potentially allowing access to the product through the retaining layer alone.

The number of removable sections of the second backing layer associated with each line of weakness can be chosen to provide a desired level of accessibility. In general, the more sections that are provided, the more difficult it will be for a child to access the product. However, in general, only two removable sections need be provided per line of weakness.

Preferably the respective removable sections completely cover the associated line of weakness to prevent access to the line of weakness.

The removable sections of the second backing layer may be defined by appropriate lines of weakness in the second backing layer. In the preferred arrangement, the sections are defined by cut lines extending through the second backing layer. However, perforations or other weakening means can be provided in other embodiments.

The shape and arrangement of the removable portions can be chosen to suit the particular blister pack layout. However, in one embodiment, the respective sections are formed by a series of mutually perpendicular parallel cuts.

One or more of the cuts defining the removable sections may extend to an edge of the second backing layer, more particularly from one edge thereof to an opposed edge thereof.

One or more of the removable sections associated with each line of weakness may be provided with means to facilitate its peeling from the first backing layer. Thus, in certain embodiments, a tab or other formation may be provided for this purpose. In one embodiment, a cut-out region may be provided at an edge of the section to allow a user to insert his or her nail under the removable section to facilitate its removal. In other arrangements, an adhesive kill may be applied to a portion of the section to provide an area which is not adhered to the first backing layer and which may therefore be easily separated therefrom.

The first and second backing layer as preferably formed of a plastics material, for example polypropylene. This provides sufficient strength to avoid a user being able simply to push the product through the respective layers without removal of the removable sections of the second backing layer. However, other materials can be used in other embodiments.

In order to manufacture the package, the first and second backing layers may be pre-formed as a label which is simply attached to the retaining layer of the blister pack in the appropriate position.

From a second aspect, therefore, the invention provides a label for attachment to a frangible retaining layer of a blister pack, the label comprising: a first backing layer for attachment to the retaining layer, said first backing layer comprising one or more lines of weakness for alignment with a blister cavity in the blister pack; and a second backing layer attached to said first backing layer on a side opposite the side for attachment to the retaining layer, the second backing layer comprising a plurality of removable sections, at least two removable sections being arranged over the line or lines of weakness in the underlying first backing layer; said label being received on a carrier comprising an adhesive repellent surface on at least one side thereof for releasably receiving the label.

In use, therefore, the label can simply be peeled off the carrier and applied to the blister pack.

Respective lines of weakness and removable sections can be provided in the first and second backing layers for alignment with respective blister cavities.

While it may be convenient in certain circumstances to apply the backing players as a preassembled label, this is not essential, and the layers may be applied separately to the retaining layer.

BRIEF DESCRIPTION OF THE DRAWINGS

An embodiment of the invention will now be described by way of example only with reference to the accompanying drawings in which.

DETAILED DESCRIPTION

Figure 1:
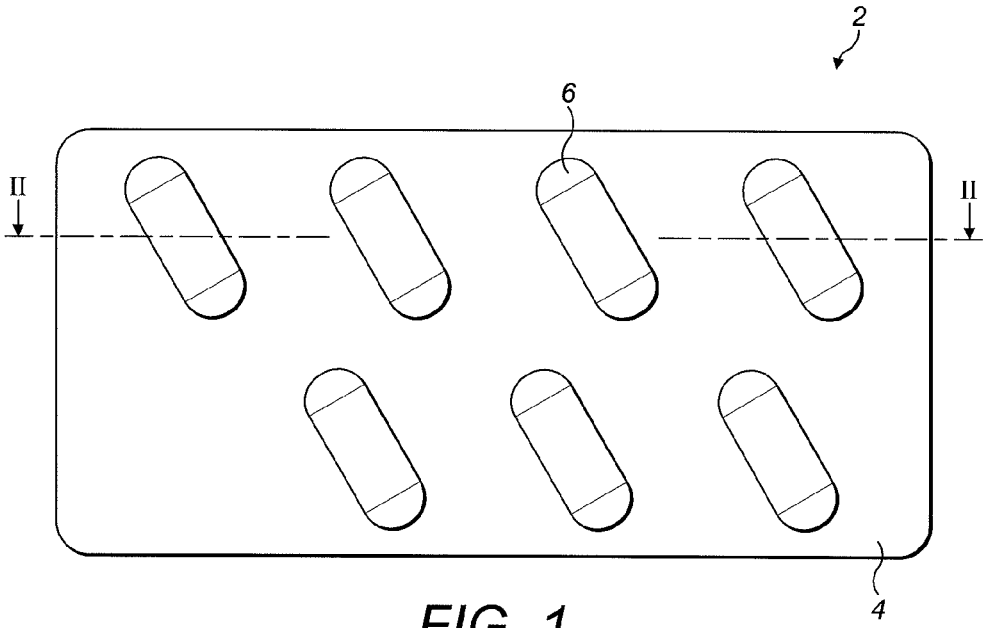
FIG. 1 shows a plan view of a blister pack in accordance with the invention.
Figure 2:
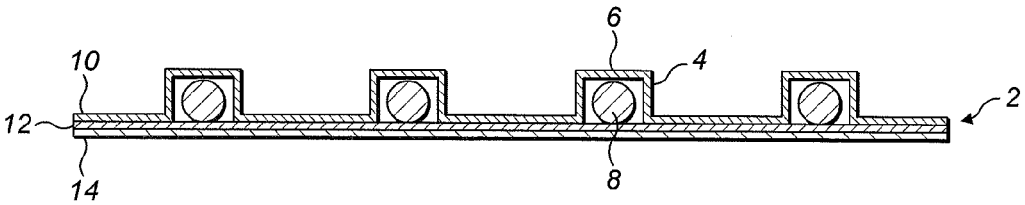
FIG. 2 shows a sectional view along line II-II of FIG. 1.

With reference to FIGS. 1 and 2, a blister pack 2 comprises a blister layer 4 which includes a plurality of blister cavities 6 for receiving product 8 such as pills, tablets and so on. As can be seen in this embodiment, the blister cavities 6 are arranged at an angle to the longitudinal axis of the blister pack 2.

As is known in the art, the blister layer 4 will typically be formed from a plastics material and may be transparent to allow a user to see the product inside the blister cavity 6.

The blister cavities 6 are closed by a frangible retaining layer 10 which is adhered, for example, heat sealed, to the underside of the blister layer 4 to retain the product in the blister cavities 6. The frangible retaining layer 10 may be of any suitable construction as known in the art, and will typically be a metal foil material.

Attached to the underside of the foil layer 10 is a first backing layer 12. The first backing layer 12 is typically made from a plastics material such as polypropylene and is adhered to the backing layer 10 by means of a layer of permanent adhesive between the two layers.

Attached to the underside of the first backing layer 12 is a second backing layer 14. The second backing layer 14 is, like the first backing layer, typically formed of a plastics material, such as polypropylene. The second backing layer 14 is attached to the first backing layer 12 by a layer of peelable adhesive applied between the two layers. As can be seen, the second backing layer 14 is continuous (i.e. does not have any access holes therein) and completely covers the first backing layer 12.

Figure 3:
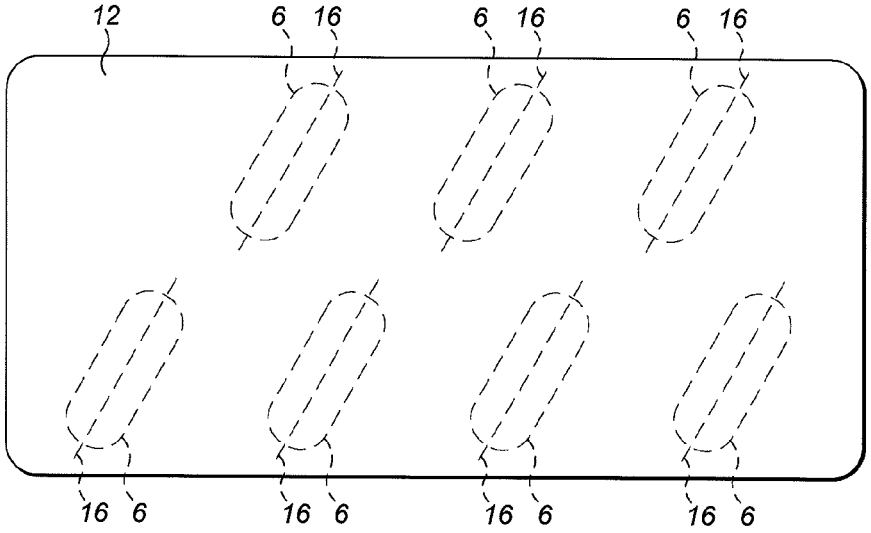
FIG. 3 shows an underside of the blister pack of FIG. 1, with the second backing layer removed.

Turning to FIG. 3, it will be seen that the first backing layer 12 comprises a series of lines of weakness 16, which are aligned with the blister cavities 6 formed in the underlying blister layer 4. In this particular embodiment, the lines of weakness 16 are lines of perforations, although other lines of weakness, for example die cut lines may be employed. The lines of weakness 16 extend beyond the respective blister cavities 6, although this is not necessary and they may extend only over a portion of the blister cavity 6 sufficient to allow the product to be pushed through the first backing layer 12.

In this particular embodiment, the blister cavities 6 are elongated and the lines of weakness 16 are aligned generally with the major axis of the respective blister cavities 6. The lines of weakness 16 may be formed along the major axis of each blister cavity 6, parallel thereto or skewed relative to the axis. Also, the lines of weakness 16 need not be straight and could for example have a wavelike shape.

Figure 4:
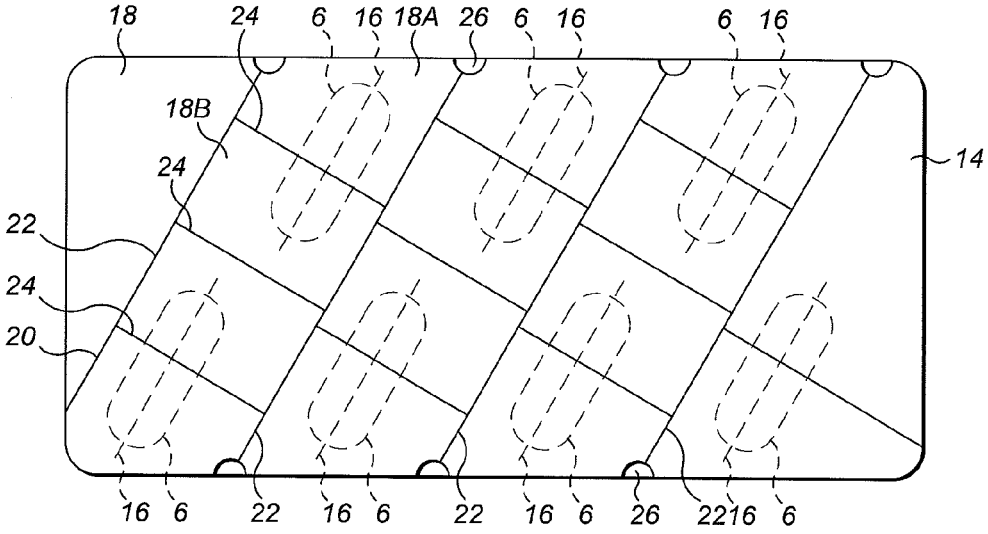
FIG. 4 shows an underside view of the blister pack of FIG. 1 showing the second backing layer.

Turning now to FIG. 4, the second backing layer 14 is formed with a series of removable sections 18 defined by a series of lines of weakness, for example cuts 20. It will be seen that the removable sections are defined by a series of first parallel cuts 22 extending generally across the second backing layer 14 from one side to the other and a series of second parallel cuts 24 extending between and transverse to the first cut lines 22. Of course this arrangement is only exemplary and other arrangements of cuts 22, 24 may be used. Thus the cuts 22, 24 need not be straight as shown, but may have some other shape such as a wavelike shape. Also, the respective series of cuts 22, 24 do not need to be parallel or perpendicular to one another as shown.

It will be seen that two removable sections, illustrated as 18A and 18B are associated with each line of weakness 16. The removable sections 18A and 18B each cover a different part of the line of weakness 16 and together they completely cover the line of weakness 16. In order to expose the line of weakness or a significant part thereof, both sections 18A and 18B must be removed. Removing only one of the sections 18A, 18B will not allow a product 8 to be forced through the first backing layer 12.

In order to facilitate dealing of the removable sections 18, cut outs 26 may be provided in the sections 18 adjacent the edge of the second backing layer 14.

In order for a user to remove the product 8 from the blister cavity 6, it is first necessary for a user to remove the two removable sections 18A and 18B of the second backing layer 14. These are peelable from the underlying first backing layer by virtue of the peelable adhesive between the two layers. Once the line of weakness 16 in the first backing layer 12 has been exposed, the user may then push the product 8 through the frangible foil layer 10 and through the first backing layer 12, this being possible by virtue of the line of weakness 16 which will break or open to allow the product 8 to be pushed through the first backing layer 12. The first backing layer 12 will either deforms or tear to allow passage of the product there through.

It would therefore be necessary for a child to perform at least three operations to remove the product 8 from the blister pack 2, namely remove a first removable section 18A, remove a second removable section 18B and then push the product out through the foil layer 10 and first backing layer 12. This provides a high level of child resistance In manufacturing of the blister pack 2, the first and second backing layers 12, 14 may be formed as a label and attached together to the frangible retaining layer 10. Accordingly, the first and second backing layers 12, 14 may be pre-formed and attached to a carrier layer having an adhesive resistant coating allowing the label to be peeled from the carrier and applied to the retaining layer 10 in an appropriate position. Alternatively the first and second backing layers 12, 14 may simply be applied as separate layers to the frangible retaining layer 10.

It will be appreciated that the description above is only of one embodiment of the invention and that modifications may be made to this embodiment within the scope of the invention. For example, the blisters may be arranged differently in the blister layer 4. They may, therefore, be arranged generally perpendicular to the edges of the blister layer. Moreover, then need not be elongate shape but could be of any other suitable shape.

Also, while the first and second backing layers 12, 14 are described as being of a plastics material such a polypropylene, this is not essential and any other material which resists the pushing out of the product 8 through the layers would be suitable. Accordingly, for example, paper may be appropriate for use in certain circumstances.

Also, while a single line of weakness 16 has been shown associated with each blister cavity 6, more than one line of weakness may be provided.

What is claimed is:

1. A child resistant blister pack, the blister pack comprising:

a blister layer comprising a plurality of blister cavities for receiving a product;

a frangible retaining layer attached to said blister layer over said plurality of blister cavities to retain product within the plurality of blister cavities;

a first backing layer attached to said retaining layer on a side opposite said blister layer, said first backing layer comprising a line of weakness aligned with each said blister cavity; and a second backing layer attached to said first backing layer on a side opposite said retaining layer;

said second backing layer comprising a plurality of removable sections, wherein at least two of the removable sections are arranged over each said line of weakness in the underlying first backing layer, each said line of weakness being a single line of weakness provided per blister cavity, the line of weakness being aligned generally with a major axis of the respective blister cavity.

2. A blister pack as claimed in claim 1 wherein each said line of weakness in the first backing layer is formed as perforations in, or cuts through, the first backing layer.

3. A blister pack as claimed in claim 1 wherein each said line of weakness extends substantially across a full dimension of the blister cavity.

4. A blister pack as claimed in claim 1 wherein the major axis of the blister cavity is aligned at an angle to the longitudinal axis of the blister pack.

5. A blister pack as claimed in claim 1 wherein the second backing layer is continuous over the first backing layer.

6. A blister pack as claimed in claim 1 wherein the first backing layer is attached to the retaining layer by means of a permanent adhesive.

7. A blister pack as claimed in claim 1 wherein the second backing layer is attached to the first backing layer by means of a peelable adhesive.

8. A blister pack as claimed in claim 1 wherein the respective removable sections completely cover the associated line of weakness.

9. A blister pack as claimed in claim 1 wherein the removable sections of the second backing layer are defined by cuts extending through the second backing layer.

10. A blister pack as claimed in claim 9 wherein the removable sections are formed by a series of mutually perpendicular parallel cuts.

11. A blister pack as claimed in claim 9 wherein at least some of the cuts extend to an edge of the second backing layer.

12. A blister pack as claimed in claim 9 wherein at least one cut extends from one edge of the second backing layer to an opposed edge thereof.

13. A blister pack as claimed in claim 1 wherein the at least two removable sections associated with each line of weakness are each provided with means to facilitate its removal from the first backing layer.

14. A blister pack as claimed in claim 13 wherein a tab or cut-out is provided at an edge of each removable section.

15. A blister pack as claimed in claim 13 wherein an adhesive kill is applied to a portion of each removable section to provide an area which is not adhered to the first backing layer.

16. A blister pack as claimed in claim 1 wherein the first and second backing layers are formed of a plastics material.

17. A blister pack as claimed in claim 16 wherein the first and second backing layers are formed of polypropylene.

* * * * *